US005566707A

United States Patent [19]

Ching et al.

[11] Patent Number: 5,566,707

[45] Date of Patent: Oct. 22, 1996

[54] PUTTY PLATE

[75] Inventors: Fred Y. F. Ching, Canyon County; Darren M. Mark, Castaic; Donald J. Segien, Jr., Chatsworth; Curtis S. Woolley, Granada Hills, all of Calif.

[73] Assignee: Emhart Inc., Newark, Del.

[21] Appl. No.: 534,911

[22] Filed: Sep. 28, 1995

[51] Int. Cl.[6] ..... F16L 5/00

[52] U.S. Cl. ..... 137/359; 137/801; 4/676; 4/696

[58] Field of Search ..... 137/801, 360, 137/359; 4/675, 676, 696

[56] References Cited

U.S. PATENT DOCUMENTS

| | | | |
|---|---|---|---|
| 612,394 | 10/1898 | Bernardi . | |
| 2,314,950 | 3/1943 | Pope . | |
| 3,010,474 | 11/1961 | Moen | 137/359 |
| 3,228,039 | 1/1966 | Freeman | 4/206 |
| 3,790,966 | 2/1974 | Keane | 4/676 |
| 3,871,034 | 3/1975 | Weigel | 277/187 |
| 3,911,946 | 10/1975 | Humpert | 137/359 |
| 4,290,445 | 9/1981 | Turner | 137/359 |
| 4,356,574 | 11/1982 | Johnson | 137/801 |
| 4,552,171 | 11/1985 | Farrell | 137/359 |
| 4,760,861 | 8/1988 | Botnick | 4/675 |
| 4,762,143 | 8/1988 | Botnick | 4/675 |
| 4,804,010 | 2/1989 | Meissenburg | 137/801 |
| 4,989,633 | 2/1991 | Humpert et al. | 4/676 |
| 5,201,433 | 4/1993 | Thul | 137/359 |
| 5,277,220 | 1/1994 | Thul | 137/359 |
| 5,368,071 | 11/1994 | Hsieh | 137/801 |

*Primary Examiner*—A. Michael Chambers
*Attorney, Agent, or Firm*—J. Bruce Hoofnagle

[57] ABSTRACT

A putty plate 30 is formed with an edge 32 in a continuous pattern to define the perimeter of the plate. A base wall of the putty plate 30 includes a floor 40 on one side of the plate 30 and a ceiling 78 on the other side of the plate. Holes 48, 60 and 62 are formed through the base wall. Four sets of ribs 52 are formed integrally from the floor 40 on the one side of the plate 30 while sets of ribs 84 are formed integrally from the ceiling 78 on the other side of the plate. Ribs 46 are formed about the holes 48 in a hexagonal configuration integrally from the floor 40 of the plate 30. Circular ribs 80 are formed about the holes 48 integrally from the ceiling 78 on the other side of the plate 30. A continuous groove 68 is formed in the base wall between the edge 32 and the ceiling 78 to define the perimeter of the ceiling. Two other putty plates 108 and 200 are formed with structure similar to the structure of the plate 30. The three putty plates 30, 108 and 200 are composed of a nylon material.

27 Claims, 10 Drawing Sheets

PUTTY PLATE

BACKGROUND OF THE INVENTION

This invention relates to a putty plate and particularly to a putty plate for use with a faucet plumbing facility of the type typically located in a kitchen, bathroom or lavatory.

Faucet plumbing facilities are available in a variety of styles and types. For example, the facility may include an underbody which comprises a pair of spaced end bodies, a center body located between the end bodies and a pair of copper tubes which link the end bodies to the center body. Water is supplied through inlet lines and supplied through the end bodies, the copper tubes, the center body and to a spout, or spout tube within a spout shell, which is connected to the center body.

The underbody can be assembled directly with a countertop as a part of a faucet unit or it may be assembled with a faucet base such as, for example, the base of a one handle or two handle faucet having a faucet housing which defines the base and spout as an integral unit. In any event, a putty plate is assembled with the underbody or the faucet base and provides a lightweight element which is designed to retain a deposit of putty as the plate is placed on a counter when assembling the associated underbody or faucet housing on the counter. As the associated underbody or faucet housing is drawn to the counter, some of the putty will ooze into the seam formed between the putty plate and the counter. The seam is thereby filled with the putty and prevents moisture from seeping or otherwise getting under the putty plate from outside the faucet unit during normal use thereof.

Typically, putty plates are extremely thin, very light and provide no bulk in support of the plumbing elements with which the plates are assembled and mainly provide a carrier for the putty as described above.

While the underbody elements are typically made from metal, the nature of their assembly, the ultimate underbody structure and the manner in which the elements are joined makes the assembly susceptible to being twisted or bent if not properly handled. Thus, there is a need for a strengthening structure to maintain the underbody in its desired and required configuration from the time of its manufacture to the time of its assembly, and thereafter, with a counter as noted above.

In addition, strengthening structure should be used with respect to an underbody in its assembly with a faucet housing prior to assembling the associated faucet unit with a counter.

SUMMARY OF THE INVENTION

In view of the foregoing needs, it is an object of this invention to provide a putty plate which is inexpensive and easy to assemble while functioning as a strengthening structure in assembly with an underbody or faucet housing.

Another object of this invention is to provide a putty plate which provides a strengthening enhancement for any underbody or faucet housing to which it is assembled while also serving as a putty carrier.

With these and other objects in mind, this invention contemplates a putty plate which has a base wall of a prescribed thickness with a floor on one side of the wall and a ceiling on the other side of the wall. A first plurality of integrally-joined ribs are integrally formed with the floor and extend outwardly therefrom in a first prescribed pattern. A second plurality of integrally-joined ribs are integrally formed with the ceiling and extend outwardly therefrom in a second prescribed pattern. A continuous groove is formed in the base wall and defines a perimeter of the ceiling thereof. At least one hole is formed through the base wall with a rib extending from the wall and surrounding the hole.

Other objects, features and advantages of the present invention will become more fully apparent from the following detailed description of the preferred embodiments, the appended claims and the accompanying drawings.

DESCRIPTION OF THE PREFERRED EMBODIMENTS

Figure 1:
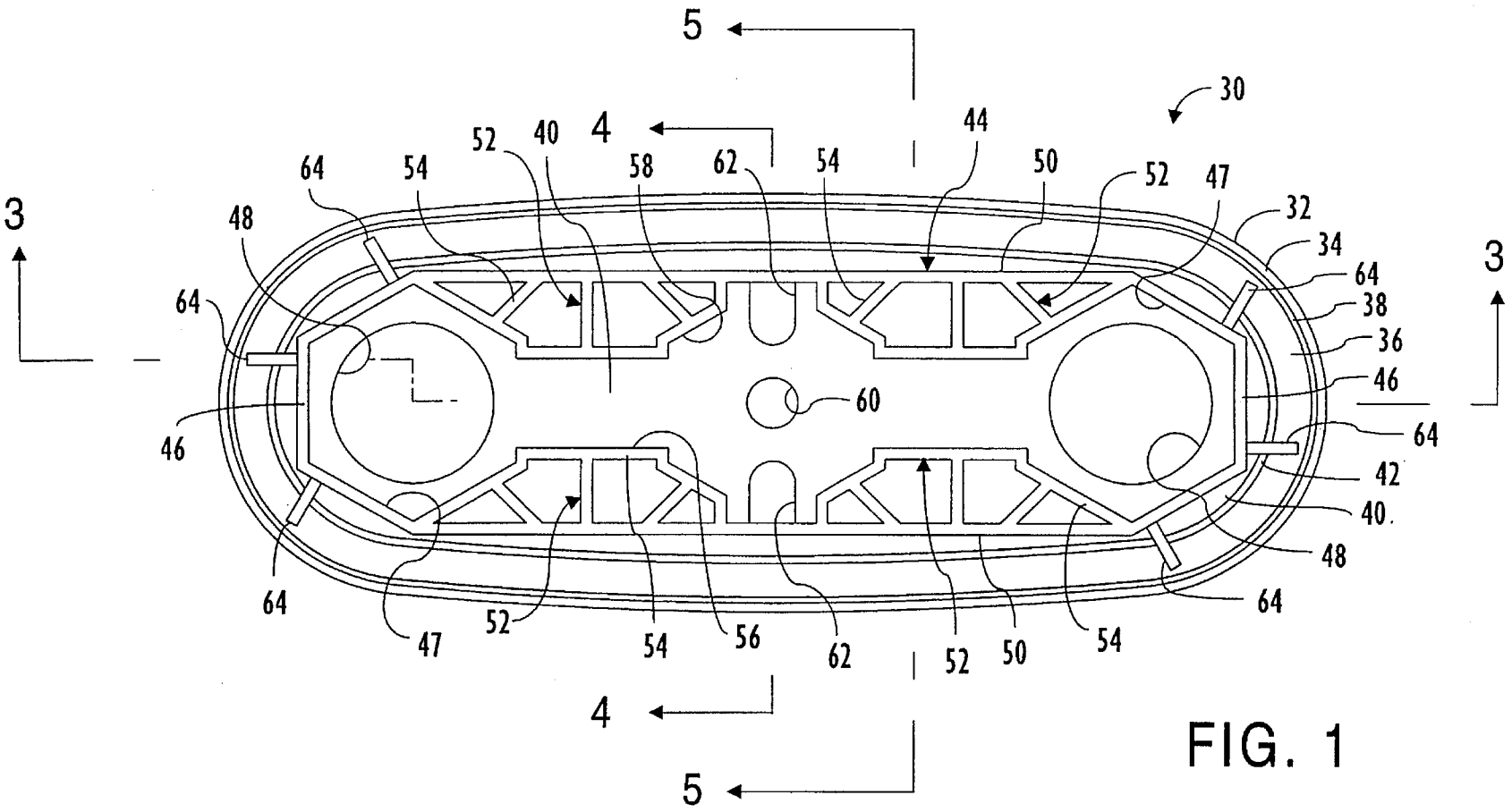
FIG. 1 is a top view showing a first preferred embodiment of a putty plate showing structural details of the plate in accordance with certain principles of the invention.

A first preferred embodiment of a single-piece putty plate 30 is illustrated in FIGS. 1 through 5 and is composed of a durable plastic material such as a nylon material available from DuPont under the trademark "Zytel" and particularly DuPont's 70G33L "Zytel" material. The putty plate 30 is formed with an edge 32 which defines the outer perimeter pattern of the plate and which is common to an upper side and a lower side of the plate. The upper side of the plate 30 is formed with a ledge 34 which is contiguous with the edge 32 and which follows the outer perimeter pattern of the plate. A first step surface 36 is formed on the plate 30 and is in a plane which is outboard of the plane of the ledge 34 and separated from the ledge by a first slightly sloping riser surface 38. A second step surface or floor 40 is formed on the plate 30 and is located in a plane which is outboard of the plane of the first step surface 36 and is separated from the first step surface by a second slightly sloping riser surface 42. The floor 40 forms a surface of the putty plate 30 on one side thereof.

A rib structure 44 extends above the step surface 40 and includes two spaced sets of ribs 46 where each set of ribs defines a hexagonal recess 47 surrounding a respective one of a pair of spaced large circular holes 48. A pair of spaced linear linking ribs 50 are joined at opposite ends thereof with the spaced sets of ribs 46. Four spaced sets 52 of ribs 54 are arranged in generally the same pattern. Each set 52 includes the individual ribs 54 which are joined together and which join with respective ones of the linking ribs 50 and sets of ribs 46. The sets 52 of ribs 54 are arranged to form an open channel 56 in the space between the holes 48 with the second step surface 40 forming a floor for the channel. Portions of each of the four sets 52 of ribs 54 are located to form a generally defined hexagonal recess 58 in the center of the upper side of the putty plate 30. A small circular hole 60 is located in the center of the recess 58 and a pair of "U" shaped holes 62 are located spatially from the hole 60 and adjacent a respective one of the linking ribs 50. A plurality of support struts 64 are formed at opposite ends of the upper side of the putty plate 30 and extend from and are joined with the first step surface 34 and are joined with the second riser surface 42, the second step surface 40 and the ribs 46.

Figure 2:
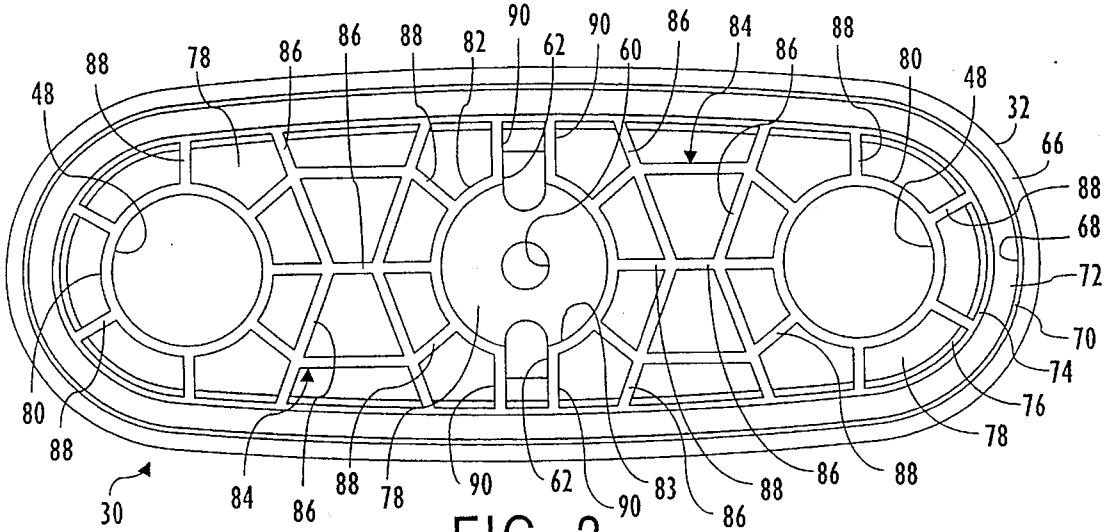
FIG. 2 is a bottom view of the putty plate of FIG. 1 showing structural details in accordance with certain principles of the invention

Referring to FIG. 2, the lower side of the putty plate 30 is formed with a shoulder 66 which is contiguous with the edge 32 and which follows the perimeter pattern of the edge. A continuous groove 68 is formed adjacent the shoulder 66 and is formed with an outer side wall 70 which is sloped slightly. The wall 70 is parallel with the first riser surface 38 as viewed in FIGS. 3, 4 and 5. A base 72 of the groove 68 is parallel with the first step surface 36 also as viewed in FIGS. 3, 4 and 5. An inside wall of the groove 68 is formed by a continuous rib 74 which extends outward from the base 72 of the groove. A wall 76 extends inward from the inboard end of the rib 74 and joins with a ceiling 78 which is located in a plane which is inboard of the base 72 of the groove 68. The wall 76 is parallel with the second riser surface 42 as viewed in FIGS. 3, 4 and 5. The ceiling 78 forms a surface of the base wall on the other side of the putty plate 30 from the side which includes the floor 40.

Figure 4:
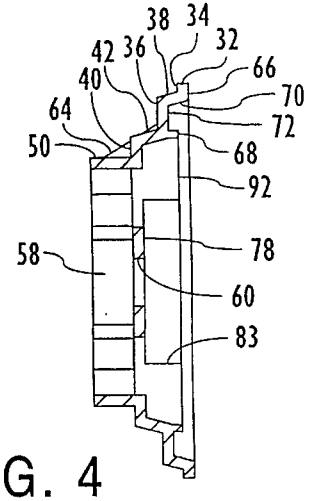
FIG. 4 is a sectional side view of the putty plate of FIG. 1 showing structural details of the plate in accordance with certain principles of the invention.
Figure 5:
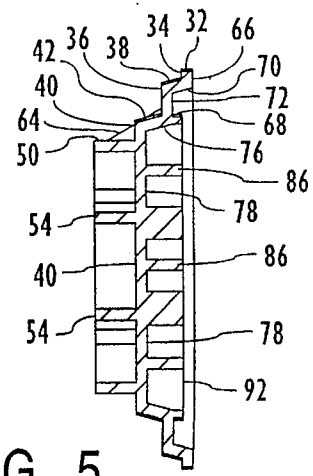
FIG. 5 is another sectional side view of the putty plate of FIG. 1 showing additional structural details of the plate in accordance with certain principles of the invention.
Figure 3:
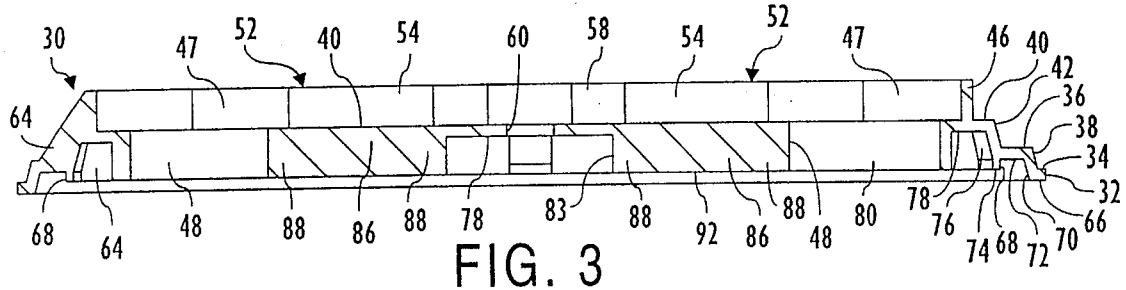
FIG. 3 is a sectional view taken along line 3—3 of FIG. 1 showing portions of the putty plate of FIG.1 in accordance with certain principles of the invention.

Two circular ribs 80 surround the holes 48 and a generally circular rib 82 is located about a central portion of the ceiling 78 which has the hole 60 formed therein to form a recess 83. A pair of grid-like sets 84 of ribs 86 extend between and are joined with the rib 74. Each of the sets 84 of ribs 86 is located between the hole 60 and a respective one of the holes 48. A plurality of spoke-like ribs 88 are joined with and radiate from the ribs 80 and 82 and join with the rib 74 or the sets 84 of ribs 86. Four ribs 90 are integral with and located between the ribs 74 and 82. The ribs 90 define walls for the openings 62 on the lower side of the plate 30. As shown in FIGS. 3, 4 and 5, an outer common surface 92 of the ribs 74, 80, 82, 86, 88 and 90 is recessed inward from shoulder 66.

Figure 6:
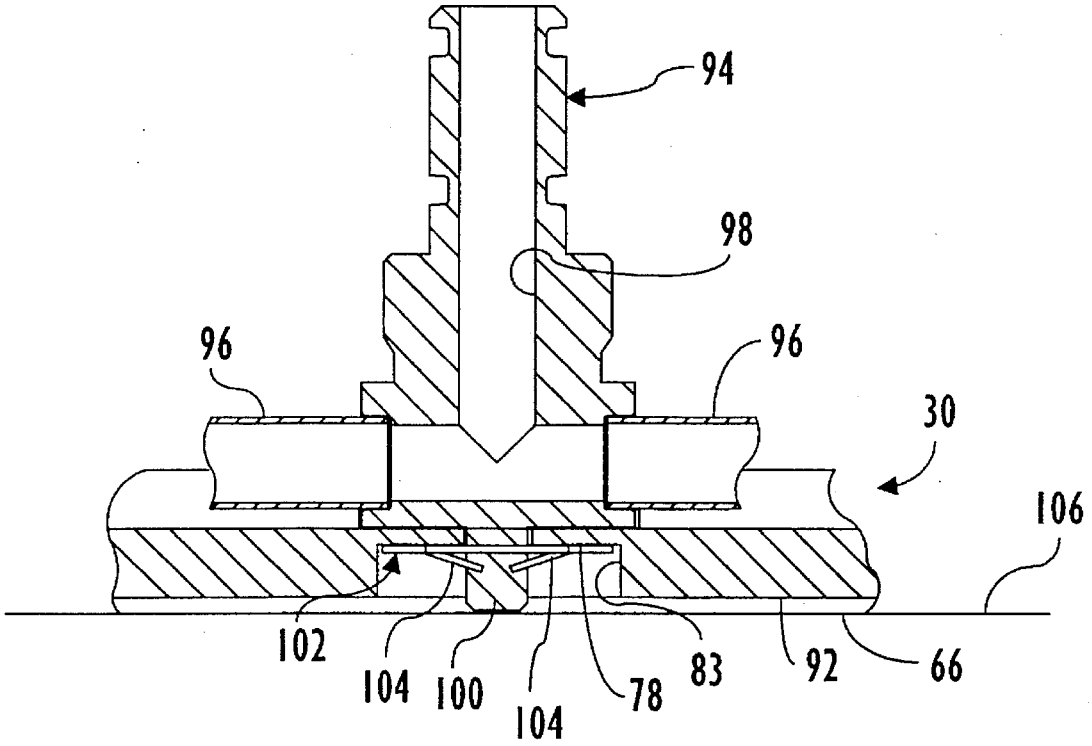
FIG. 6 is a sectional view showing a portion of the putty plate of FIG. 1 in assembly with a center body of an underbody.

As shown in FIG. 6, an underbody assembly includes a center body 94 and a pair of copper tubes 96 secured thereto. The opposite ends of the copper tubes 96 are secured to a respective one of a pair of end bodies (not shown) which are connected to water supply conduits. Water is supplied through the end bodies and copper tubes 96 to a water passage 98 within the center body 94 and then to a spout (not shown) which is assembled to the top of the center body. The putty plate 30 is formed with the recess 83 in an underside thereof and the hole 60 which extends from the top of the putty plate into communication with the recess. A pin 100 is formed integrally at the bottom of the center body 94 and is inserted into the hole 60 and extends into the recess 83 of the putty plate 30.

A press nut 102 is pressed onto the pin 100 from the bottom of the putty plate 30 and into the recess 83 to assist in securing the putty plate with the center body 30 and the underbody assembly. The press nut 102 is formed from a single piece of flat metal including a pair of outward-turned interfacing tabs 104 which are formed above a hole (not shown) in the body. Each of the tabs 104 is formed with a "V" shaped notch (not shown) which are interfacing. As shown in FIG. 6, the press nut 102 is positioned with the tabs 104 extending downward. The hole of the nut 102 is moved over the pin 100 of the center body 94 whereby the notches engage and are dragged over the pin and the flat body is pressed firmly against the ceiling 78 of the recess 83 of the putty plate 30. The angle of the tabs 104 relative to the flat body and the pin 100 facilitates retention of the putty plate 30 with the center body 94.

During a procedure for installing the assembled putty plate 30 and the underbody assembly with a counter top 106, putty is applied to the underside of the putty plate 30 and is particularly deposited into the groove 68. Threaded sections of the end bodies are inserted into respective holes (not shown) of the counter top 106. Nuts are mounted on the threaded sections of the end bodies and are secured under the counter top 106 to draw the putty plate 30 toward the counter top. As the putty plate 30 is drawn to the counter top 106, some of the putty will ooze from the deposit under the putty plate and fill a seam formed between the shoulder 66 of the plate and the counter top to serve as a moisture barrier and prevent moisture from entering the seam from the outside. Excess putty which has been exuded outside of the seam during the assembly process can then be removed to provide a finished appearance.

The end bodies and the center body 94 each are formed with an hexagonal section. When the underbody assembly is assembled with the putty plate 30, the hexagonal sections of the end bodies nest in the hexagonal recesses 47 formed by rib structure in the upper side of the plate 30. Further, the hexagonal section of the center body 94 nests in the hexagonal recess 83 formed by rib structure in the upper side of the plate 30. The end bodies are formed with cylindrical sections which are threaded on the outer surfaces thereof. The cylindrical sections are located in the large holes 48. Channel 56 formed by rib structure in the upper side of the putty plate 30, provides a trough for the copper tubes 96 and the lower end of the center body 94.

Figure 7:
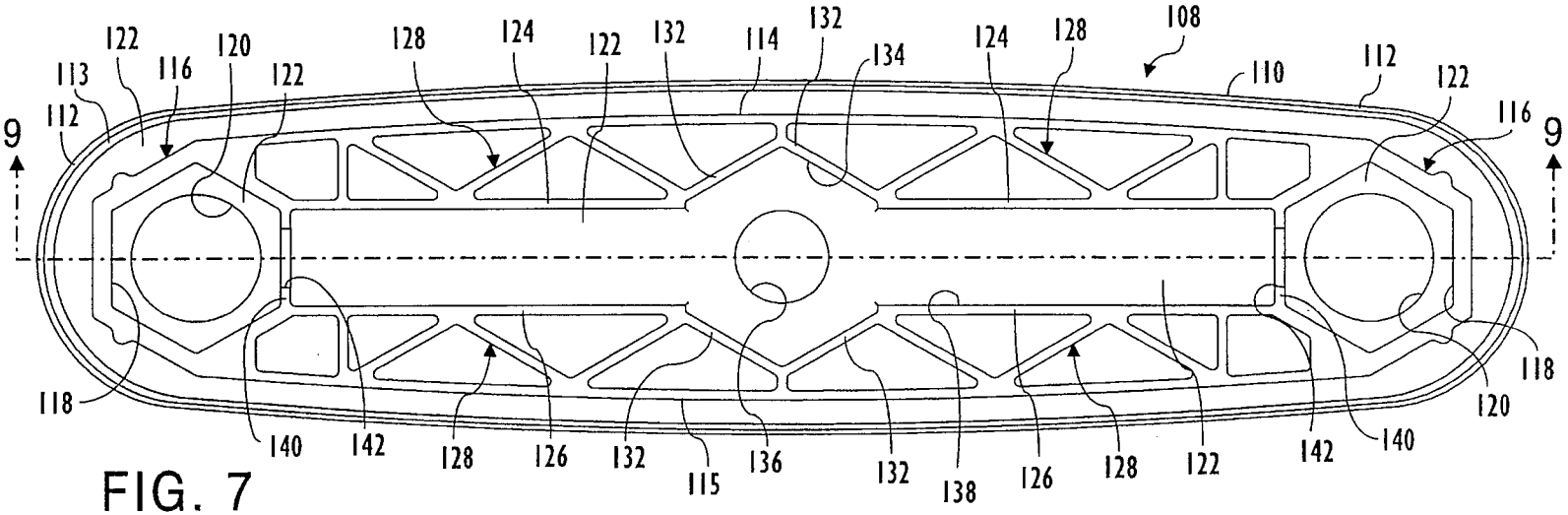
FIG. 7 is a top view showing a second preferred embodiment of a putty plate showing structural details of the plate in accordance with certain principles of the invention.

A second preferred embodiment of a putty plate 108 is illustrated in FIGS. 7 through 10. As shown in FIG. 7, the putty plate 108 is formed with an outer edge 110 which defines the outline of the plate. An upper side of the putty plate 108 is formed with a ledge 112 which is contiguous with the edge 110 and which extends around the plate in the outline of the edge. A first rib 114 and a second rib 115 are each formed inboard of an adjacent portion of the ledge 112 and extend from near one end of the plate 108 to near the other end of the plate. A pair of hexagonally shaped ribs 116 are formed at opposite ends of the upper side of the plate 108 and each form a hexagonal recess 118 surrounding a hole 120 formed through a floor 122 of the upper side. The opposite ends of each of the ribs 114 and 115 are integrally joined with respective portions of the hexagonally shaped ribs 116. A first pair of extended ribs 124, and a second pair of extended ribs 126, are spatially inboard of the adjacent portions of the ribs 114 and 115, respectively, and are spaced from each other. The floor 122 forms a surface of a base wall on one side of the putty plate 108.

A grid of triangularly shaped ribs 128 are formed between, and with, the ribs 114 and 124. Another grid of triangularly shaped ribs 130 are formed between, and with, the ribs 115 and 126. Each of the grids of ribs 128 and 130 extend between the hexagonal ribs 116 at opposite ends of the plate 108. A plurality of ribs 132 form a portion of the grids of ribs 128 and 130 and are located in the center of the plate 108 to form generally a hexagonal recess 134 which surrounds a hole 136 formed in the floor 122 at the precise center of the plate. The set of in-line ribs 124 and the parallel, spaced set of in-line ribs 126 form a channel 138 which extends between the hexagonal ribs 116. At opposite ends of the channel 138, a rib section 140 of each of the hexagonal ribs 116 is formed with a rectangular or square shaped slot 142.

Figure 8:
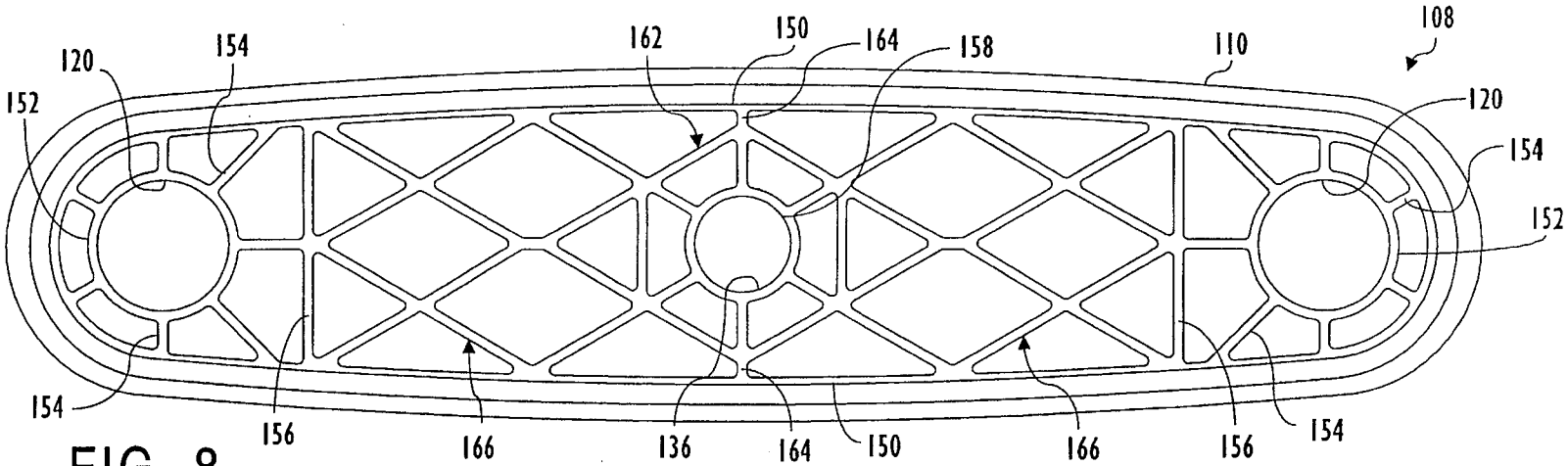
FIG. 8 is a bottom view of the putty plate of FIG. 7 showing structural details of the plate in accordance with certain principles of the invention.
Figure 9:
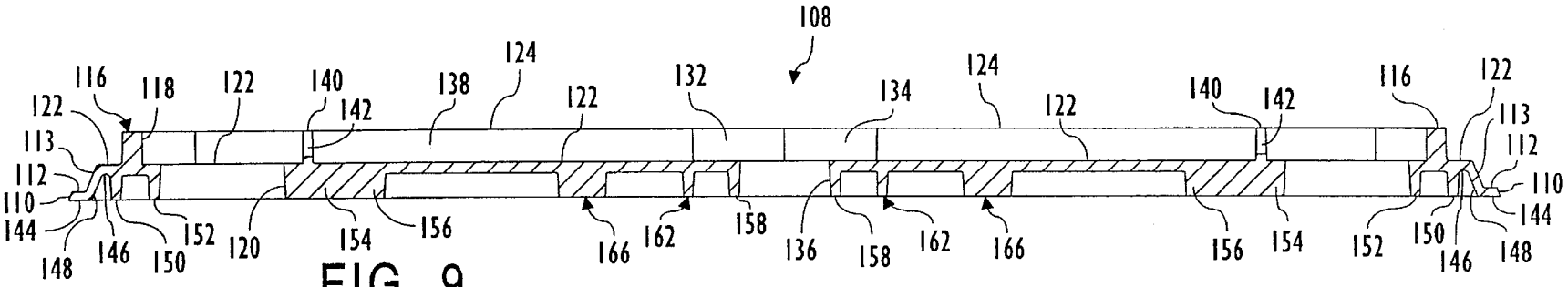
FIG. 9 is a sectional view taken along line 9—9 of FIG. 7 showing structural details of the putty plate of FIG. 7 in accordance with certain principles of the invention.

Referring to FIG. 8, the putty plate 108 is formed with a lower side which includes a shoulder 144 contiguous with, and which follows the outline of, the edge 110 of the plate. A continuous groove 146 is formed adjacent the shoulder 144 and follows the outline thereof. An outboard sloped surface 148 of the groove 146 forms the inner surface of a wall which includes the outer sloped surface 113. A continuous rib 150 is inboard of the groove 146 and follows the outline thereof. The rib 150 is formed integrally with and extends from a ceiling 153 which forms a surface of the base wall on the other side of the putty plate 108 which is opposite the side of the floor 122. A pair of circular ribs 152 surround the holes 120. A plurality of spoke-like ribs 154 extend radially from each of the circular ribs 152 and some join with the continuous rib 150 at opposite ends thereof and others join with a respective one of a pair of linking ribs 156, each of which extend between spaced respective portions of the rib 150. A circular rib 158 surrounds the hole 136 and joins with a plurality of spoke-like ribs 160. The opposite ends of the spoke-like ribs 160 join with the corners of a hexagonal set of ribs 162 which are linked to the rib 150 by a pair of spaced short ribs 164. A pair of spaced sets of honeycomb-patterned ribs 166 join with respective ones of the ribs 156, respective portions of the rib 150 and respective portions of the hexagonal set of ribs 162. The ribs 152, 154, 156, 158, 160, 162, 164 and 166 are formed integrally with and extend from the ceiling 153.

Figure 11:
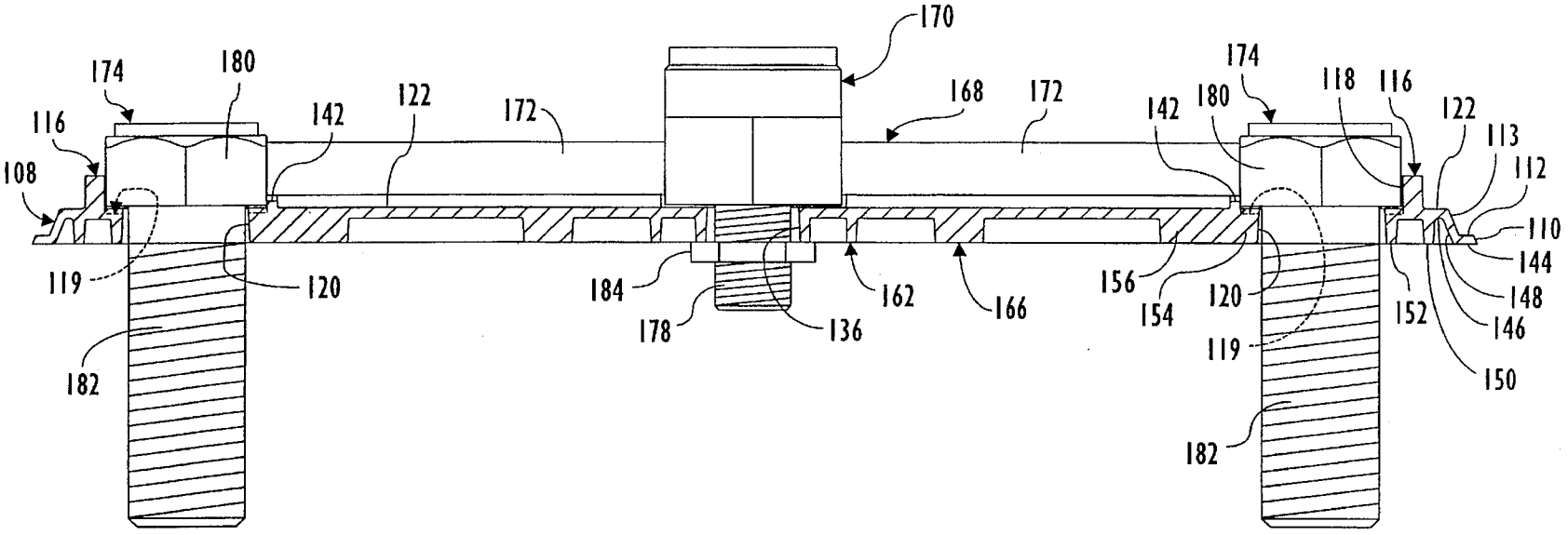
FIG. 11 is a partial sectional view showing the putty plate of FIG. 7 in assembly with an underbody.

Referring to FIG. 11, an underbody assembly 168 includes a center body 170, a pair of copper tubes 172 and a pair of end bodies 174. The tubes 172 are interposed between the center body 170 and a respective one of the end bodies 174 and facilitate the flow of water from the end bodies, through the tubes, through the center body and through a spout (not shown) which is attached to the center body. The center body 170 is formed with a hexagonal section 176 and includes a threaded nipple 178 extending from the bottom thereof. Each of the end bodies 174 is formed with a hexagonal section 180 and a threaded cylindrical section 182.

When assembling the putty plate 108 with the underbody assembly 168, the cylindrical sections 182 of the end bodies 174 are aligned with the holes 120 of the plate from the upper side of the plate. In this alignment, the nipple 178 of the center body 170 is aligned with the hole 136 of the putty plate 108. The putty plate 108 and the underbody assembly 168 are moved relatively toward each other so that the cylindrical sections 182 and the nipple 178 are inserted into the respective holes 120 and 136. The slots 142 provide a clearance for the copper tubes when the underbody assembly 168 if assembled with the putty plate 108. A nut 184 is threadedly secured on the threaded nipple 178 as shown in FIG. 11 to secure the underbody assembly 168 with the putty plate 108. Putty is then applied to the underside of the putty plate 108 and is particularly deposited into the groove 146. The threaded sections 182, and the nipple 178 and nut 184, are inserted into respective holes of a counter top (not shown). Nuts are mounted on the threaded sections 182 of the end bodies 174 and are secured under the counter top to draw the putty plate 108 toward the counter top. As the putty plate 108 is drawn to the counter top, some of the putty will ooze from the deposit under the putty plate and fill a seam formed between the shoulder 144 of the plate and the counter top to serve as a moisture barrier and prevent moisture from entering the seam from the outside. Excess putty which has been exuded outside of the seam during the assembly process can then be removed to provide a finished appearance.

Figure 10:
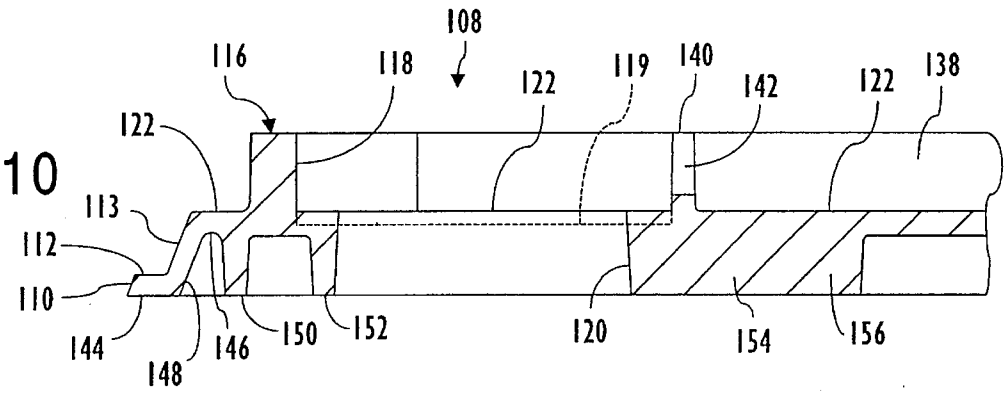
FIG. 10 is an enlarged view of a portion of FIG. 9 showing structural details of the putty plate of FIG. 7 and an alternate embodiment in accordance with certain principles of the invention.

As illustrated in FIGS. 10 and 11, each of the hexagonal recesses 118 can be formed with a slightly greater depth, for example, as shown by dashed lines 119 than the depth shown in solid lines. In this embodiment of greater depth, when the nuts are located threadedly on the threaded sections 182 of the end bodies 174, and are tightened under the putty plate 108 in the manner described above, the hexagonal sections 180 of the end bodies are drawn essentially onto the floor of the hexagonal recesses 118 whereby the copper tubes 172 are bent slightly downward at the endbody ends thereof. This insures that the hexagonal sections 180 of the end bodies 174 are firmly seated in the recesses 118, to lessen the opportunity for noise to be generated when water is flowing through, or pressurized conditions change in, the underbody assembly 168. In this embodiment, the rib section 140 may be removed or the slot 142 in the rib section may be formed more deeply to accommodate the necessary clearance for the copper tubes 172.

Figure 12:
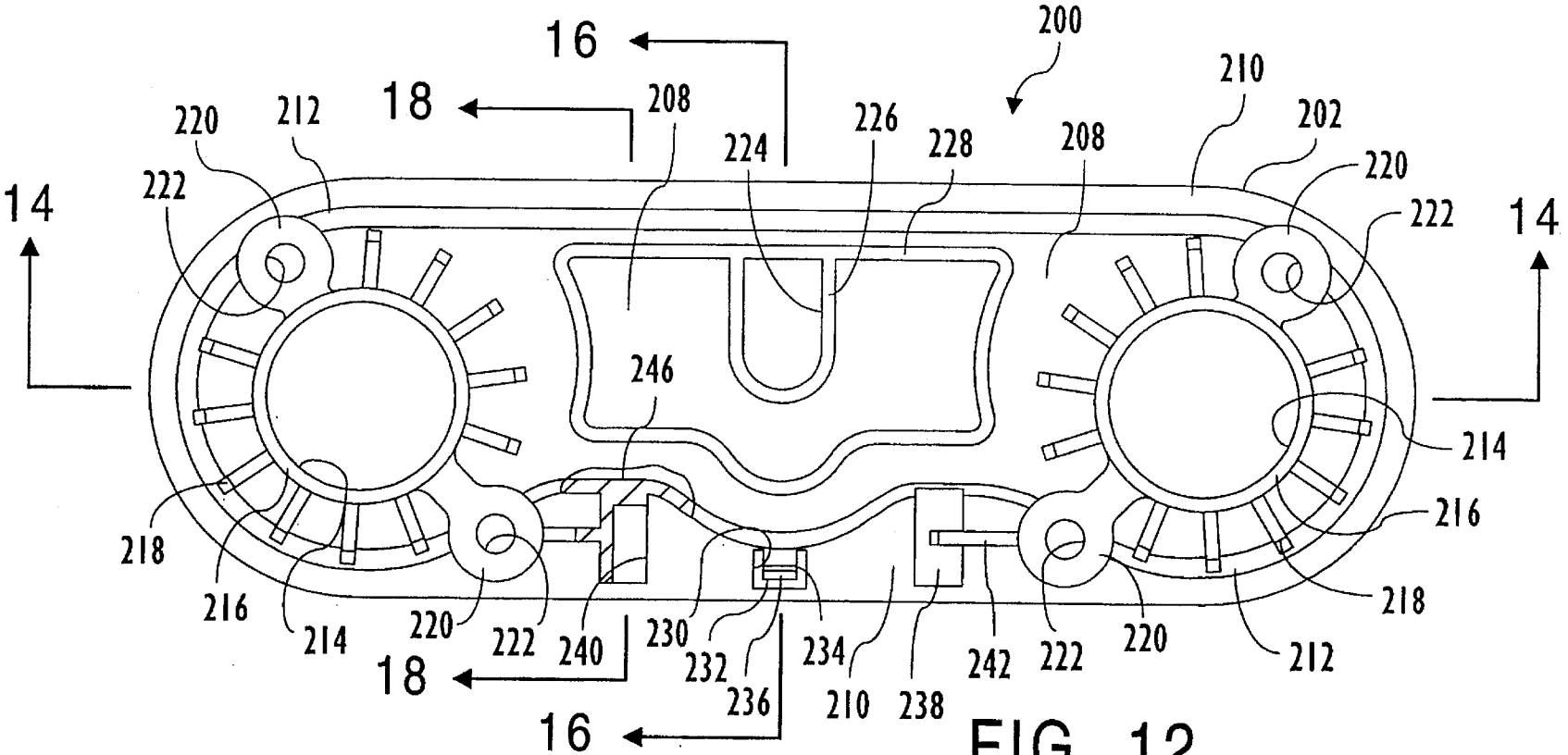
FIG. 12 is a top view of a third preferred embodiment of a putty plate showing structural details of the plate in accordance with certain principles of the invention.

A third preferred embodiment of a putty plate 200 is shown in FIGS. 12 through 18. The putty plate 200 is also composed of a plastic material such as the durable nylon material available from DuPont under the trademark "Zytel" and particularly DuPont's 70G33L "Zytel" material. The putty plate 200 has a perimeter edge 202 which conforms generally to the shape and size of the bottom of a base 204 (FIG. 19) of a faucet housing 206. As shown in FIG. 12, the putty plate 200 is formed on an upper side thereof with a raised floor 208 which, when assembled with the base 204, will face inward of the base in the manner illustrated in FIG. 20. A ledge 210 is also formed on the inner side of the putty plate 200 contiguous with the perimeter edge 202. The ledge 210 is spaced inboard of the putty plate 200 from the raised floor 208 with a slightly sloping transition surface 212 (FIG. 14) located between the ledge and the raised floor. A pair of holes 214 are formed in the floor 208. Each of the holes 214 is encircled with a circular reinforcing rib 216 and a plurality of radially arranged reinforcing spoke-like ribs 218. The floor 208 forms a surface of a base wall on one side of the putty plate 200.

Figure 13:
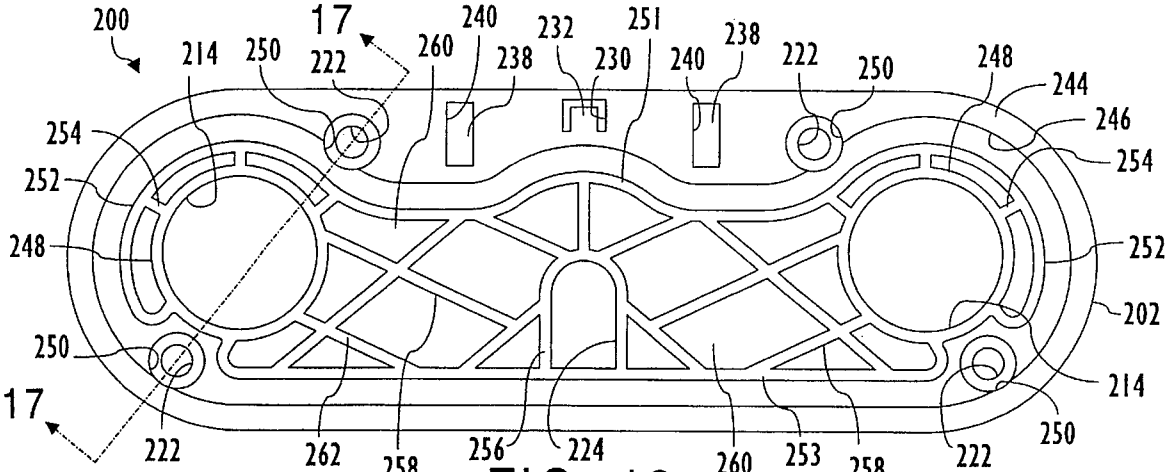
FIG. 13 is a bottom view of the putty plate of FIG. 12 showing structural details of the plate in accordance with certain principles of the invention.

A pair of bosses 220 with holes 222 is formed adjacent each hole 214 and extend from the floor 208 and the ledge 210. An opening 224 is formed generally in the center of the floor 208 and is surrounded by a continuous reinforcing rib 226 which is joined to a larger reinforcing rib 228. As shown in FIGS. 12 and 13, a "U" shaped slot 230 is formed in the ledge 210 and provides an outline for a locking tab 232 with a latch bar 234 formed thereacross. The latch bar 234 is formed with a bevelled slope 236 at a forward or free end thereof. The surface of the tab 232 from which the latch bar 234 extends is flush with the ledge 210 whereby the latch bar extends outward from the surface. A pair of "L" shaped guide channels 238 are formed integrally with ledge 210 adjacent a respective hole 240 formed in the ledge 210 and are located on either side of the tab 232. Each of the channels 238 are also integrally joined to the plate 200 through a respective linking bar 242. It is noted that the channels 238 and the respective linking bars 240 are formed as an integral portion of the plate 200 during the molding of the plate. Also, the rear of the channels 238 are integrally molded with the adjacent portion of the slope 212.

Referring to FIG. 13, a lower side of the plate 200 is formed with a shoulder 244. A continuous groove 246 is formed around an inner perimeter of the ledge 244. The outer slope of the groove 246, which is adjacent the ledge 244, forms the inner wall of the slope 212 (FIG. 14) which is formed on the upper side of the putty plate 200. Circular reinforcing ribs 248 are formed about the holes 214 while recesses 250 are formed about the holes 222. A pair of arcing ribs 252 are each formed spatially adjacent a portion of a respective one of the ribs 248 and are contiguous with the groove 246. A plurality of ribs 254 integrally link each of the arcing ribs 252 with the respective rib 248. A first perimeter rib 251 is located adjacent the inner edge of the groove 246 and joins the circular ribs 248 at opposite ends of the rib 251. A second perimeter rib 253 is located adjacent a serpentine section of the groove 246 and joins the arcing ribs 252 at opposite ends of the rib 253. A rib 256 surrounds hole 224 and is joined with a honeycomb pattern of integrally joined ribs 258 which are located generally between the holes 214 and about the hole 224. A ceiling 260 is located within spaces defined, and not occupied, by the ribs 248, 251, 252, 253, 254, 256 and 258. The ceiling 260 is in a plane inboard of a plane which includes the shoulder 244 and is generally flush with the base of the groove 246. The ceiling 260 forms a surface of the base wall on the side of the putty plate 200 opposite from the side which includes the floor 208.

Figure 14:
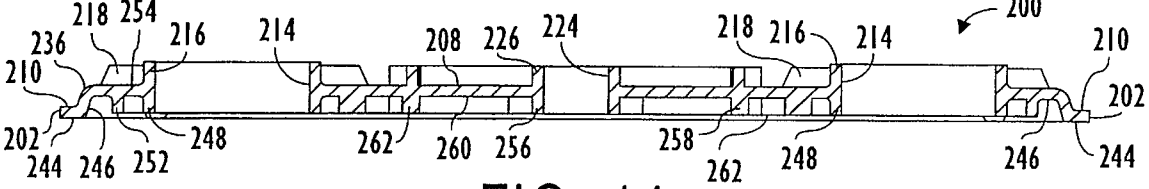
FIG. 14 is a sectional view taken along line 14—14 of FIG. 12 of the putty plate of FIG. 12 showing structural details of the plate in accordance with certain principles of the invention.
Figure 17:
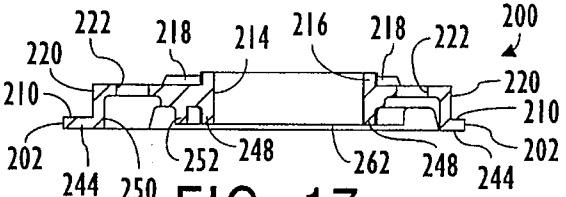
FIG. 17 is a sectional view taken along line 17—17 of FIG. 13 showing structural details of the putty plate of FIG. 13 in accordance with certain principles of the invention.
Figure 16:
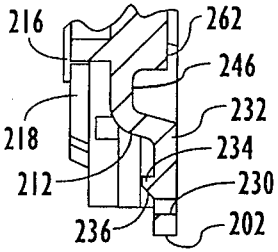
FIG. 16 is a sectional view taken along line 16—16 of FIG. 12 showing structural details of the putty plate of FIG. 12 in accordance with certain principles of the invention.
Figure 15:
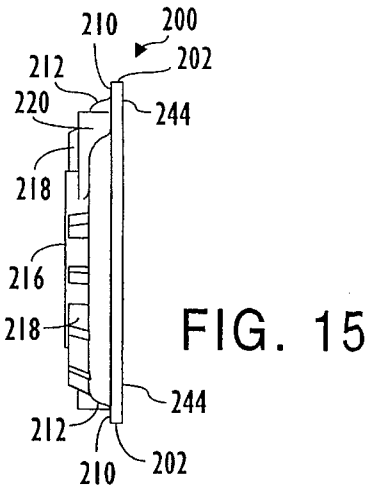
FIG. 15 is an end view of the putty plate of FIG. 12 showing structural details of the plate in accordance with certain principles of the invention.
Figure 18:
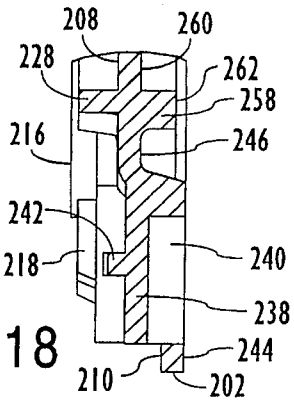
FIG. 18 is a sectional view taken along line 18—18 of FIG. 12 showing structural details of the putty plate of FIG. 12 in accordance with certain principles of the invention.

It is noted that all of the ribs 216, 218, 226, 228, 248,251, 252, 253, 254, 256 and 258 are integral components of the putty plate 200 and are joined to provide an exceptional strengthening arrangement for the putty plate. It is further noted that, as illustrated in FIG. 14, an integrally formed common edge 262 of the ribs 248, 251, 252, 253, 254, 256 and 258 is in a plane which is slightly recessed inboard from a plane which includes the shoulder 244 for the reasons expressed above with respect to putty plate 30.

The putty plate 200 is also composed of the durable material as noted above which provides a strengthening enhancer for any faucet with which the plate is assembled. The various structures including ribs and the like further enhance the strengthening attribute of the plate 200. When combining the type of material and the thickness of the plate 200, the plate assumes a generally rigid character which provides considerable stability for the faucet.

Figure 19:
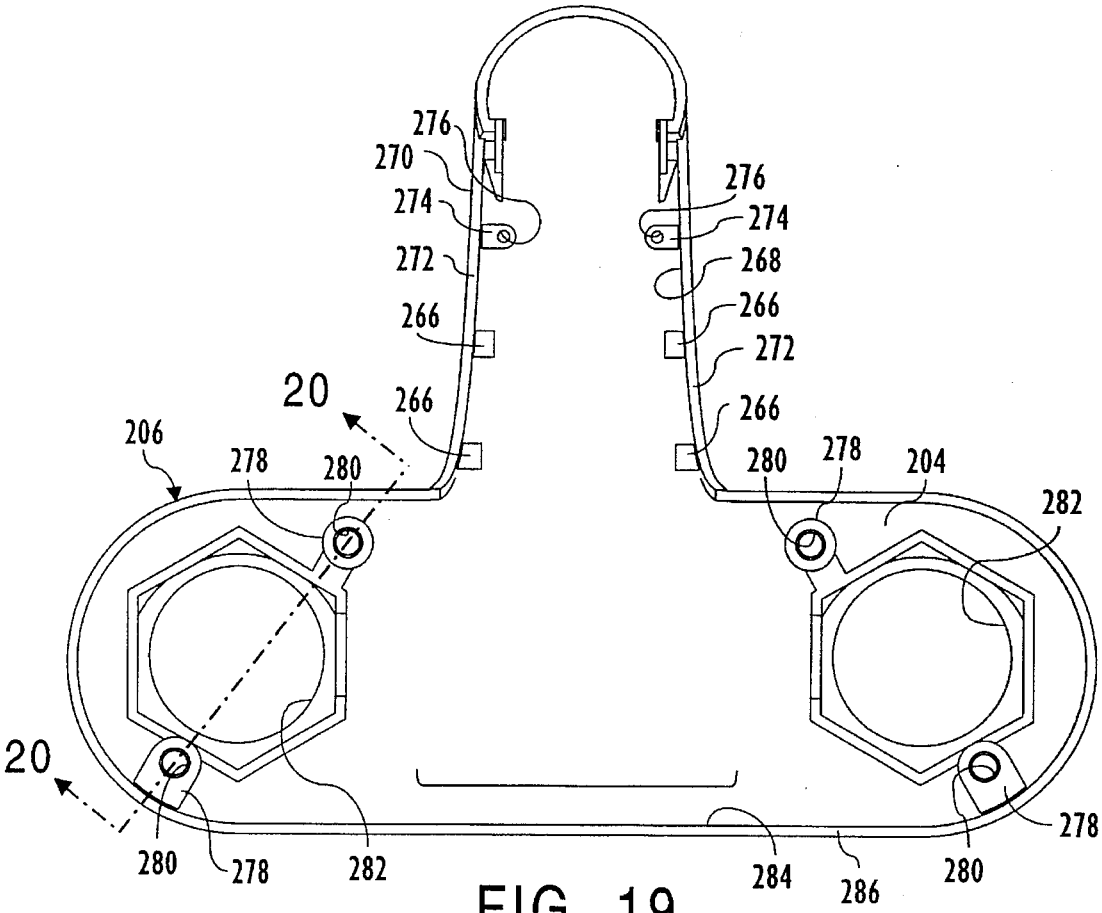
FIG. 19 is a bottom view of a faucet housing.
Figure 20:
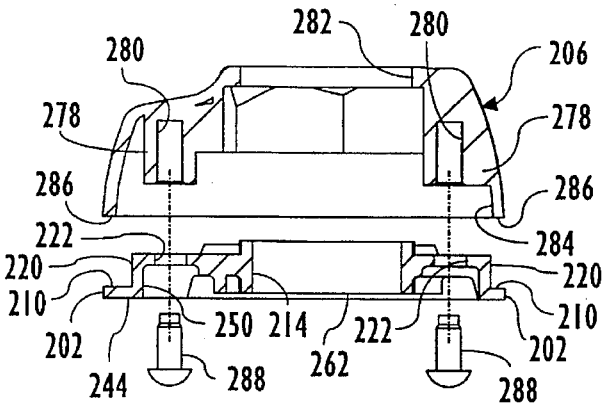
FIG. 20 is a sectional view of the faucet housing of FIG. 19 taken along line 20—20 showing the putty plate of FIGS. 12 and 13 in position for assembly with the housing.

As shown in FIG. 19, the faucet housing 206 is formed with several support ribs 266 in an inner wall 268 of a spout 270 with the outer edges of the ribs being slightly recessed from adjacent edges 272 of the spout. A pair of bosses 274 are each formed with a hole 276 and are formed within the spout 270. Two sets of bosses 278 with holes 280 are formed on the inside of the housing 206 adjacent a pair of holes 282 which are formed in the housing for receipt of valve assemblies (not shown). The housing 206 is formed with an inner opening 284 and has a perimeter edge 286 formed around the opening to define the boundary thereof.

As shown in Fig, 20, a pair of round head metallic drive screws 288 are used to secure the putty plate 200 with the housing 206. In particular, the putty plate 200 is moved relatively toward the housing 206 from the underside thereof. The holes 222 of the putty plate 200 are thereby aligned with respective holes 280 of the housing 206 and the putty plate is inserted into the opening 284 of the housing. Eventually, perimeter edge 286 of the housing 206 engages the adjacent perimeter portions of the ledge 210 of the putty plate 200 and the drive screws 288 are driven into the openings 280 to secure the putty plate with the housing 206.

Figure 21:
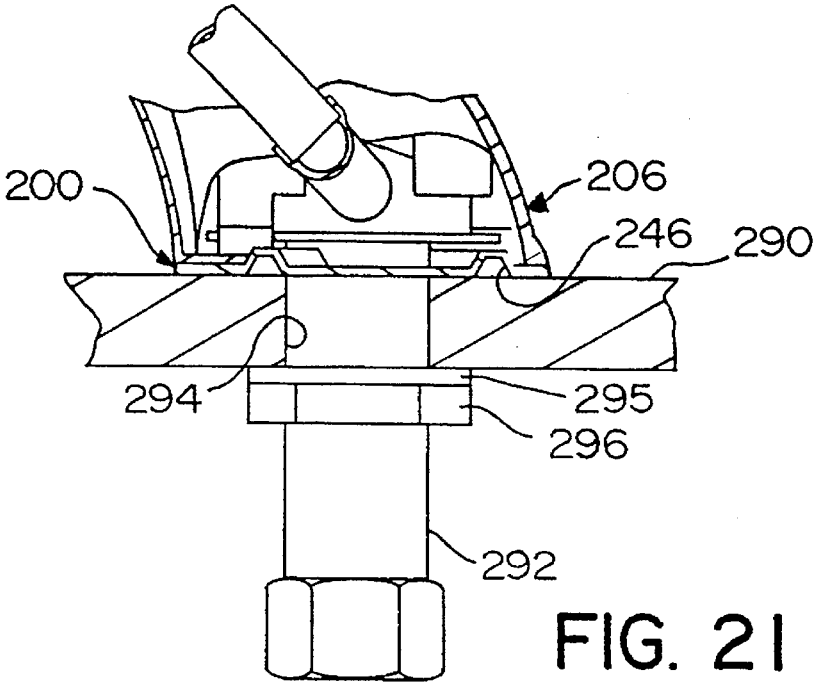
FIG. 21 is a sectional view showing a faucet assembly of the putty plate of FIGS. 12 and 13, the faucet housing of FIG. 19 and an underbody all in assembly with a counter.
Figure 22:
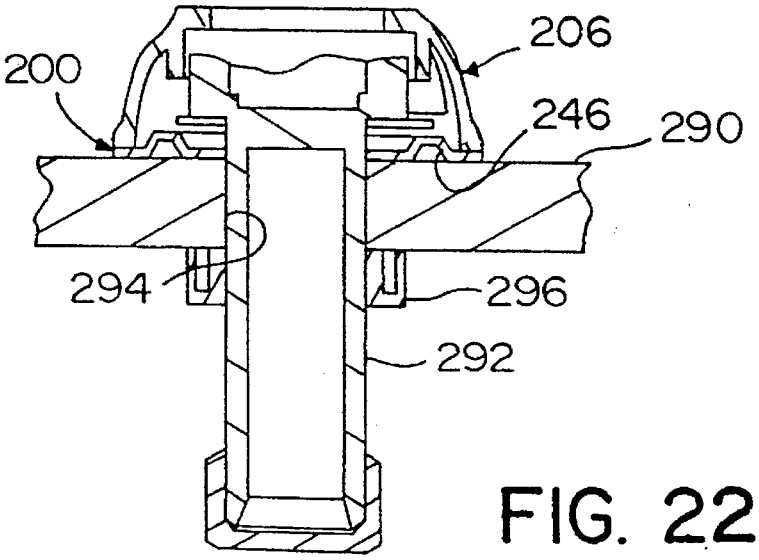
FIG. 22 is a sectional view showing another portion of the faucet assembly of FIG. 21 in assembly with the counter.

Referring to FIGS. 21 and 22, the faucet housing 206 can be assembled on and secured to a counter top 290 by inserting the end bodies 292 of an associated underbody assembly through openings 294 in the counter top from the top thereof so that the lower portion of the end bodies extend below the counter top. A washer 295 and a nut 296 are then placed over the lower portion of each respective end body 292 and threadedly secured under the counter top 290 to secure the faucet housing 206 and associated faucet to the counter top.

During a procedure for installing the assembled putty plate 200 and the underbody assembly with a counter top 290, putty is applied to the underside of the putty plate 200 and is particularly deposited into the groove 246. Threaded sections of the end bodies 292 are inserted into respective holes 294 of the counter top 290. Nuts are mounted on the threaded sections of the end bodies 292 and are secured under the counter top 290 to draw the putty plate 200 toward the counter top. As the putty plate 200 is drawn to the counter top 290, some of the putty will ooze from the deposit under the putty plate and fill a seam formed between the ledge 244 of the plate and the counter top to serve as a moisture barrier and prevent moisture from entering the seam from the outside. Excess putty which has been exuded outside of the seam during the assembly process can then be removed to provide a finished appearance.

Each of the above-described three preferred putty plates 30, 108 and 200 is formed from a durable material such as the nylon noted above and is designed with a base wall and various integrally-joined ribs extending from opposite sides of the wall and intermediate supporting structures and the like to provide a rigid strengthening member. The rigidity of the putty plates 30, 108 and 200 are enhanced by the thickness of the base wall and the plurality of ribs on each side thereof. In the three preferred embodiments of the putty plates 30, 108 and 200, the prescribed thickness is 0.065 inch. Other thicknesses could be used without departing from the spirit and scope of the invention. When the rigid strengthening member is attached to an underbody assembly and/or a faucet housing, the strong rigidity of the strengthening member precludes unwanted twisting of the underbody assembly or faucet housing.

In general, the above-identified embodiments are not to be construed as limiting the breadth of the present invention. Modifications, and other alternative constructions, will be apparent which are within the spirit and scope of the invention as defined in the appended claims.

What is claimed is:

1. A putty plate, which comprises:

a base wall of a prescribed thickness with a first surface on one side of the wall and a second surface on the other side of the wall;

a first plurality of integrally-joined ribs integrally formed with and extending outward from the first surface in a first prescribed pattern;

a second plurality of integrally-joined ribs integrally formed with and extending outward from the second surface in a second prescribed pattern;

a continuous groove formed in the base wall in a continuous pattern which defines a perimeter of the first and second surfaces;

at least one hole formed through the base wall; and a rib surrounding at least a portion of the at least one hole.

2. The putty plate as set forth in claim 1, wherein the first and second plurality of ribs are of a thickness which is substantially the same as the prescribed thickness.

3. The putty plate as set forth in claim 2, wherein the prescribed thickness is 0.065 inch.

4. The putty plate as set forth in claim 1, which further comprises:

an edge formed in a prescribed pattern which defines the perimeter of the putty plate; and a ledge formed contiguous with the edge and inboard thereof on a first side of the putty plate.

5. The putty plate as set forth in claim 4, which further comprises a shoulder formed contiguous with the edge and inboard thereof on a second side of the putty plate which is opposite the first side.

6. The putty plate as set forth in claim 5, wherein the second plurality of ribs are formed with outer edges which are located in-a common plane and the shoulder is located in a plane which is outboard of the common plane.

7. The putty plate as set forth in claim 4, which further comprises a pair of spaced interfacing "L" shaped channels formed integrally from the ledge adjacent a section of the edge.

8. The putty plate as set forth in claim 7, which further comprises:

a tab formed integrally along one edge with the base wall;

a bar formed on an outward facing surface of the tab; and a slope formed on the bar in a prescribed location.

9. The putty plate as set forth in claim 4, which further comprises a step surface located in a plane parallel with and between a plane which includes the first surface of the base wall and a plane which includes the ledge.

10. The putty plate as set forth in claim 1, wherein the hole is a circular hole and the rib which surrounds at least a portion of the hole is circular.

11. The putty plate as set forth in claim 10, which further comprises a third plurality of ribs integrally formed with the base wall on one side thereof and with, and extending radially outward from, an outer side wall of the circular rib.

12. The putty plate as set forth in claim 1, wherein the hole is a circular hole and the rib which surrounds at least a portion of the hole is hexagonal in configuration.

13. The putty plate as set forth in claim 1, which further comprises at least a second hole for facilitating connection of the putty plate with another element.

14. The putty plate as set forth in claim 1, which further comprises a channel formed partially by the base wall and partially by the first plurality ribs.

15. The putty plate as set forth in claim 14, wherein the channel extends along the base wall from the at least one hole.

16. The putty plate as set forth in claim 14, which further comprises:

a first channel rib formed across a first selected portion of the channel; and a second channel rib formed across a second selected portion of the channel at a location spaced from the first channel rib.

17. The putty plate as set forth in claim 11, which further comprises a slot formed in at least one of the first and second channel ribs.

18. The putty plate as set forth in claim 14, which further comprises:

the hole-surrounding rib is a five-sided rib arranged about the hole in a hexagonal configuration with five integrally joined walls and an open space; and the channel formed on the base wall extending from the hole and through the open space.

19. The putty plate as set forth in claim 18, which further comprises a channel rib formed across the channel at a location adjacent the open space.

20. The putty plate as set forth in claim 19, which further comprises a slot formed in the channel rib.

21. The putty plate as set forth in claim 1, which further comprises a recessed surface formed about the at least one hole in a plane which is parallel to and inboard of a plane of the first surface of the base wall.

22. The putty plate as set forth in claim 21, which further comprises the recessed surface surrounded by six joined walls in a hexagonal configuration to form a hexagonal enclosure about the hole.

23. The putty plate as set forth in claim 22, which further comprises five joined ribs extending outward from five of the six walls to form an extended enclosure about the hole.

24. The putty plate as set forth in claim 1, wherein the groove is formed with a base surface representing the deepest surface of the groove and the base surface is in a plane with the second surface of the base wall.

25. The putty plate as set forth in claim 1, wherein the groove is formed with a base surface representing the deepest surface of the groove and the base surface is in a plane which is parallel with and inboard of a plane which includes the second surface of the base wall.

26. The putty plate as set forth in claim 1, which further comprises the putty plate being composed of a plastic material.

27. The putty plate as set forth in claim 26, wherein the plastic material is nylon.

* * * * *